US011299913B2

(12) United States Patent
Promutico et al.

(10) Patent No.: US 11,299,913 B2
(45) Date of Patent: Apr. 12, 2022

(54) DOOR LOCKING DEVICE, PARTICULARLY FOR ELECTRICAL HOUSEHOLD APPLIANCES

(71) Applicant: BITRON S.p.A., Turin (IT)

(72) Inventors: Fabrizio Promutico, Alatri (IT); Massimo Nardini, Alatri (IT); Marcello Pollastri, Rome (IT)

(73) Assignee: BITRON S.p.A., Turin (IT)

( * ) Notice: Subject to any disclaimer, the term of this patent is extended or adjusted under 35 U.S.C. 154(b) by 300 days.

(21) Appl. No.: 16/604,029

(22) PCT Filed: Apr. 9, 2018

(86) PCT No.: PCT/IB2018/052441

§ 371 (c)(1),
(2) Date: Oct. 9, 2019

(87) PCT Pub. No.: WO2018/189640

PCT Pub. Date: Oct. 18, 2018

(65) Prior Publication Data

US 2021/0102403 A1 Apr. 8, 2021

(30) Foreign Application Priority Data

Apr. 10, 2017 (IT) ..... 102017000039143

(51) Int. Cl.
*E05B 47/00* (2006.01)
*E05B 47/06* (2006.01)
(Continued)

(52) U.S. Cl.
CPC ..... *E05B 47/0006* (2013.01); *D06F 37/42* (2013.01); *E05B 47/0603* (2013.01);
(Continued)

(58) Field of Classification Search
CPC ..... D06F 37/42; D06F 39/14; D06F 34/20; E05B 47/0603; E05B 17/22;
(Continued)

(56) References Cited

U.S. PATENT DOCUMENTS 3,623,343 A * 11/1971 Haller et al. ..... E05B 47/0696 68/139
4,286,811 A * 9/1981 Schantz ..... E05B 47/0009 292/201
(Continued)

FOREIGN PATENT DOCUMENTS

EP 0 172 331 A1 2/1986
EP 2 812 678 A 2/2008
(Continued)

OTHER PUBLICATIONS

International Search Report for PCT/IB2018/052441 dated Jun. 1, 2018 [PCT/ISA/210].

*Primary Examiner* — Mark A Williams
(74) *Attorney, Agent, or Firm* — Sughrue Mion, PLLC

(57) ABSTRACT

Door-locking device (1) comprising an electromechanical control device (10), which includes a locking pin (11) adapted to cooperate with a movable latching slider (7) for locking a door of an electric household appliance. The control device comprises a yoke (21), a magnet part (22) fixed to the yoke (21) and comprising a permanent magnet (23) polarized along a direction substantially perpendicular to the yoke (21), two electromagnets (26) arranged on opposite sides of the magnet part (22), and a rocking keeper (29) comprising two arms (29*a*, 29*b*) connected at an angle to each other, the keeper resting on a supporting surface (25) of the magnet part (22) so as to be able to rock between a first and a second position respectively in contact with one or the other of the cores (27) of the electromagnets (26).

7 Claims, 9 Drawing Sheets

(51) Int. Cl.
*D06F 37/42* (2006.01)
*D06F 34/20* (2020.01)
*D06F 39/14* (2006.01)

(52) U.S. Cl.
CPC ..... *D06F 34/20* (2020.02); *D06F 39/14* (2013.01); *E05Y 2900/312* (2013.01)

(58) Field of Classification Search
CPC ..... E05B 2047/0007; E05B 2047/0016; E05B 47/0001; E05B 47/0002; E05B 47/0004; E05B 47/0038; E05B 65/0014; E05Y 2900/312
See application file for complete search history.

(56) References Cited

U.S. PATENT DOCUMENTS 4,342,476 A * 8/1982 Brown ..... D06F 37/42 292/201
5,019,935 A * 5/1991 Nakamura ..... H01R 13/7135 361/45
5,629,662 A * 5/1997 Floyd ..... H01H 71/145 337/36
6,082,787 A * 7/2000 Chioffi ..... D06F 37/42 292/128
2010/0308664 A1* 12/2010 Face ..... H02J 13/00036 307/104
2013/0229245 A1* 9/2013 Li ..... H01H 51/2272 335/81
2013/0293032 A1* 11/2013 Promutico ..... H02H 11/00 307/326
2015/0021929 A1* 1/2015 Osvatic ..... E05B 47/0012 292/144
2015/0354248 A1* 12/2015 Promutico ..... D06F 37/42 292/138
2020/0115843 A1* 4/2020 Milost ..... D06F 39/14

FOREIGN PATENT DOCUMENTS

WO 2010/026536 A1 3/2010
WO 2015/140585 A1 9/2015

* cited by examiner

DOOR LOCKING DEVICE, PARTICULARLY FOR ELECTRICAL HOUSEHOLD APPLIANCES

CROSS REFERENCE TO RELATED APPLICATIONS

This application is a National Stage of International Application No. PCT/M2018/052441, filed on Apr. 9, 2018, which claims priority from Italian Patent Application No. 102017000039143, filed on Apr. 10, 2017.

BACKGROUND OF THE INVENTION

Field of the Invention

The present invention relates to a door-locking device, particularly for electrical household appliances.

More specifically, the invention relates to a door-locking device of the type comprising an electromechanical control device including a locking pin adapted to cooperate with a movable latching slider to lock a door of an electrical household appliance, said locking pin being movable between a rest position, wherein the locking pin allows the latching slider to move, and a lock position, wherein the locking pin prevents said latching slider from moving.

An object of the present invention is to provide a door-locking device of this type, which has a compact and reliable geometry.

SUMMARY OF THE INVENTION

This and other objects are achieved according to the invention with a door-locking device of the type defined above, characterized in that said electromechanical control device comprises a yoke of magnetically conductive material;

a magnet part fixed to the yoke and comprising a permanent magnet polarized in a direction substantially perpendicular to the yoke;

two electromagnets arranged on opposite sides of the magnet part, each electromagnet comprising a core of magnetically conductive material fixed to the yoke, and a solenoid wound to the core; and a rocking keeper of magnetically conductive material, comprising two arms connected at an angle to each other through a corner portion of the keeper, said corner portion resting on a support surface of the magnet part in such a way that the keeper is able to rock around the corner portion, between a first and a second position in contact with one or the other of the cores of the electromagnets, respectively;

wherein the locking pin is connected to one of the arms of the keeper in such a way as to assume the rest position or the lock position when the keeper is in the first position or in the second position, respectively.

With such a configuration, it is possible to obtain better performance in terms of accuracy of the movement, immunity from external magnetic fields and costs/dimensions with respect to known direct-voltage solutions which provide, for example, for the use of motors or solenoids.

Preferred embodiments of the present invention are the subject of the dependent claims, which form an integral part of the present description.

BRIEF DESCRIPTION OF THE DRAWINGS

Further features and advantages of the invention will become apparent from the detailed description that follows, provided purely by way of non-limiting example with reference to the accompanying drawings, wherein.

DETAILED DESCRIPTION OF THE INVENTION

Figure 1:
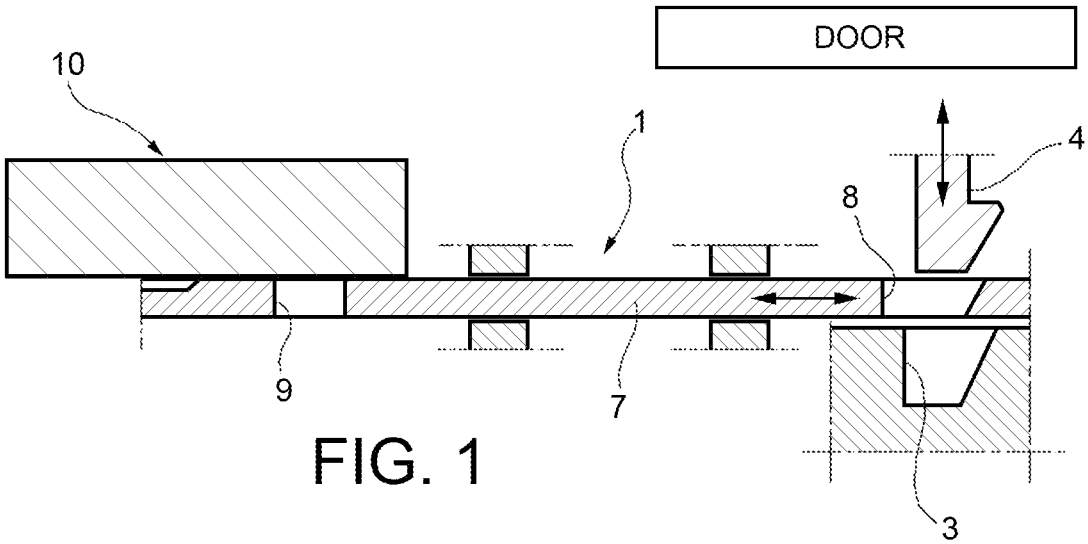
FIG. 1 is a simplified view of a door-locking device according to the present invention.

In FIG. 1, a door-locking device is collectively indicated at 1.

The device has an opening 3 adapted to allow the insertion of a coupling member, such as the one indicated at 4 in FIG. 1.

In a manner known per se, the door-locking device 1 is adapted to be fixed in the proximity of an opening of an electrical household appliance, for example a washing machine, and the coupling member 4 is intended to be connected, for example in an articulated way, to a movable door associated with such opening of the household electrical appliance.

A latching slider, axially movable in a direction which is approximately orthogonal to the direction of insertion of the coupling member 4 in the opening 3, is indicated at 7.

The latching slider 7 has a main opening 8, which, in the various operating conditions or positions of the slider 7, at least partially faces and is aligned with the opening 3 of the door-locking device.

By inserting the coupling member 4 of the door into the opening 3, such coupling member 4 interacts in a manner known per se with the slider 7, causing it to move against the action of elastic means (not shown). When the door is closed, the coupling member 4 of the door is arranged with the end head thereof engaged in the opening 8 of the slider 7. In such condition, a portion of the neck of the coupling member 4 is held between the opening 3 and the slider 7.

The coupling member 4 and the coupling configuration between the slider 7 and the coupling member 4 of FIG. 1 are shown for illustrative purposes only, and do not form part of the present invention.

The door-locking device 1 further comprises an electromechanical control device, generally indicated at 10 in the figures.

Figure 2:
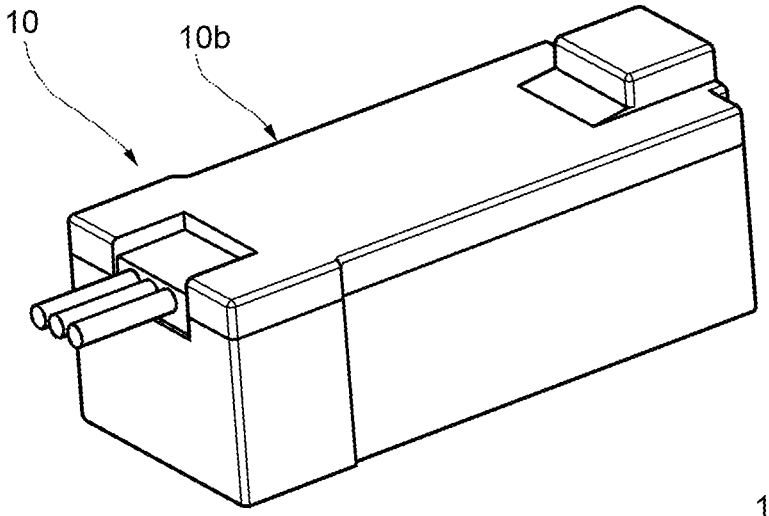
FIGS. 2 and 3 are perspective views of an electromechanical control device of the door lock of FIG. 1.
Figure 3:
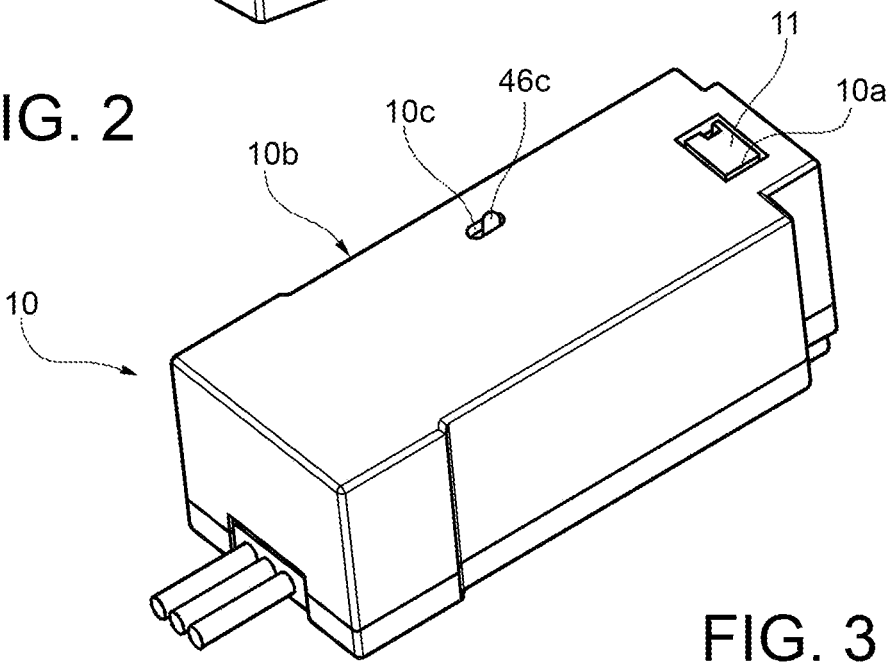
Figure 4:
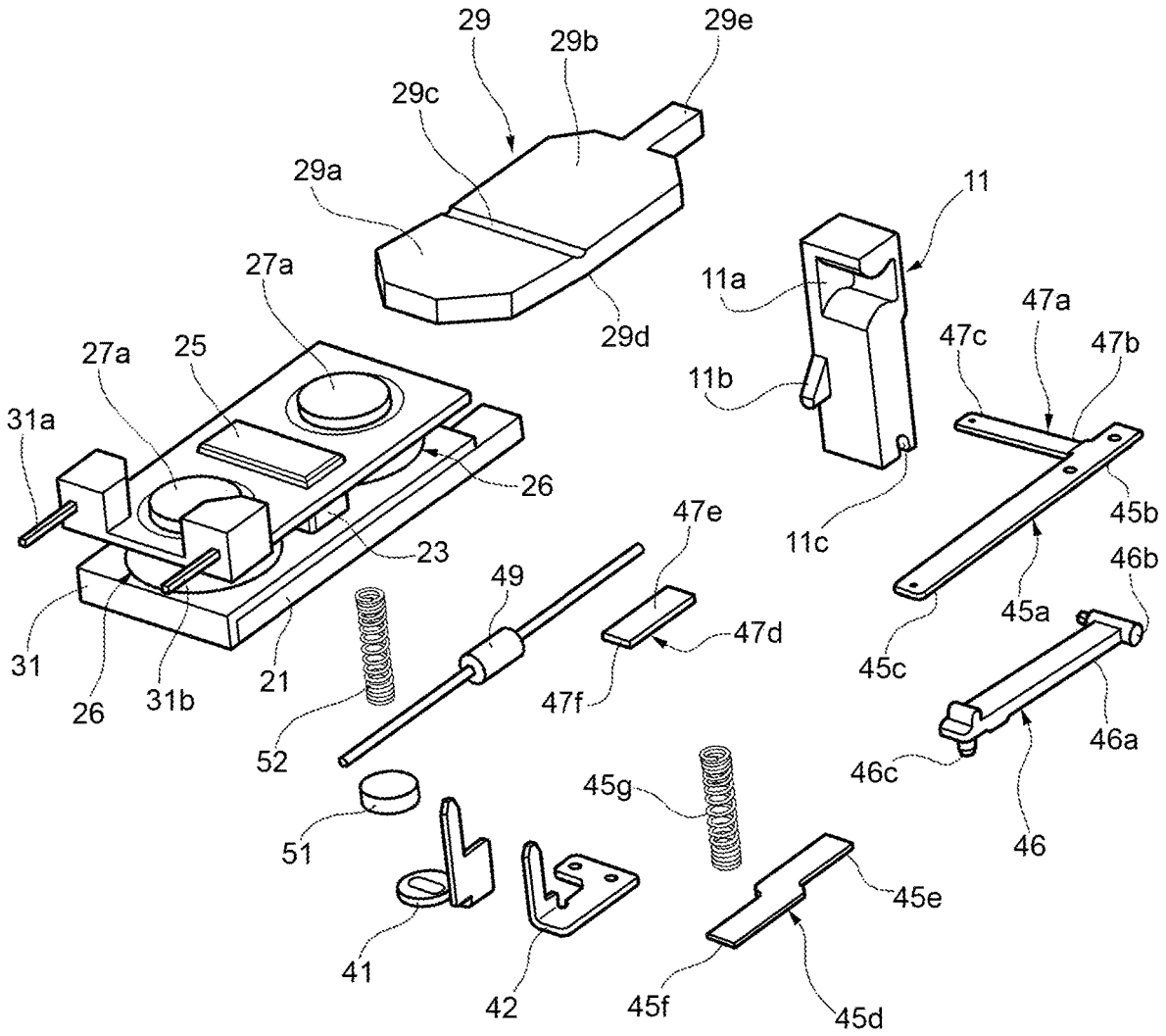
FIGS. 4 and 5 are exploded views of the device of FIGS. 2 and 3, without the casing.

The electromechanical control device 10 includes a movable locking pin, indicated at 11 in FIG. 2 and subsequent figures. Such member is mounted axially movable, in a vertical direction for those observing FIG. 1, through an opening 10*a* made in the casing 10*b* of the electromechanical device 10, facing the area wherein the latching slider 7 is movable.

Figure 9:
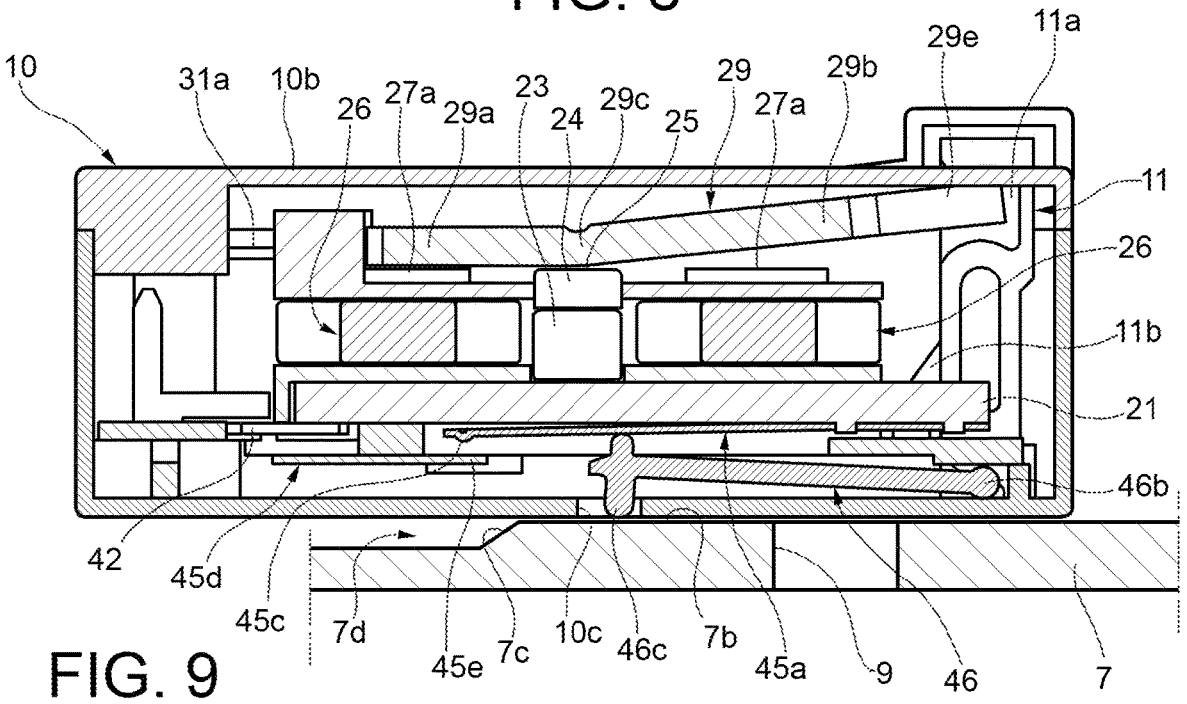
FIGS. 9 and 10 are sectional views of the device of FIGS. 2 and 3, in a condition corresponding to the state of the electrical diagram shown in FIG. 6.
Figure 12:
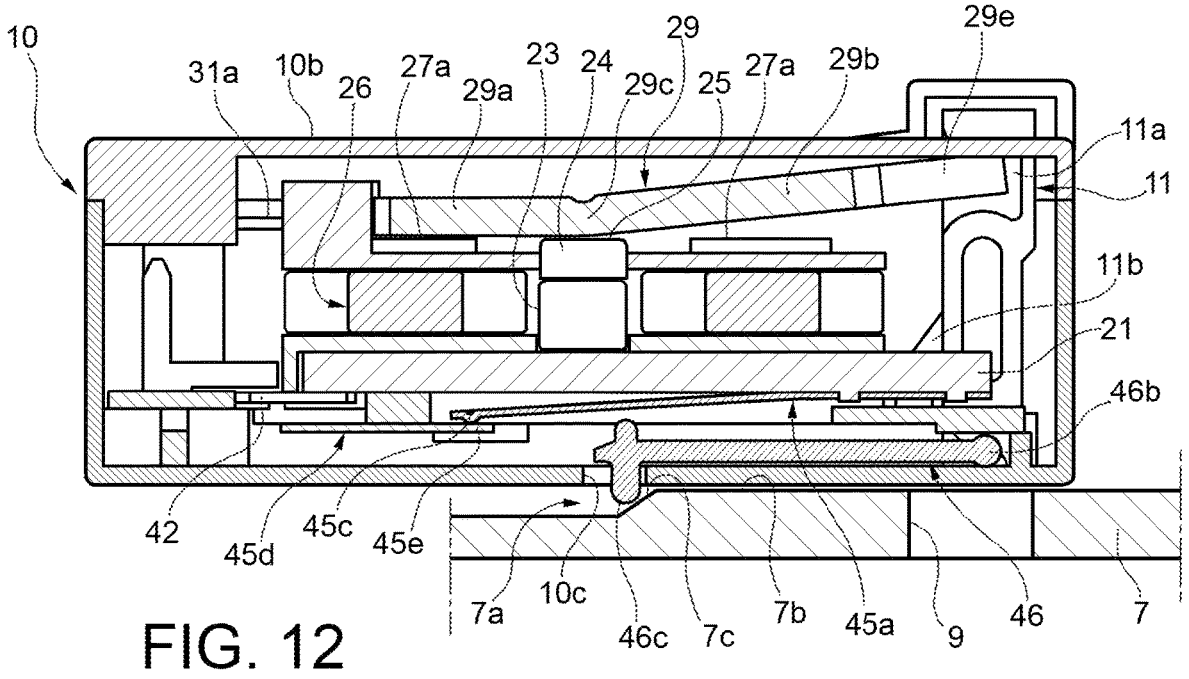
FIGS. 12 and 13 are sectional views of the device of FIGS. 2 and 3, in a condition corresponding to the state of the electrical diagram shown in FIG. 11.
Figure 15:
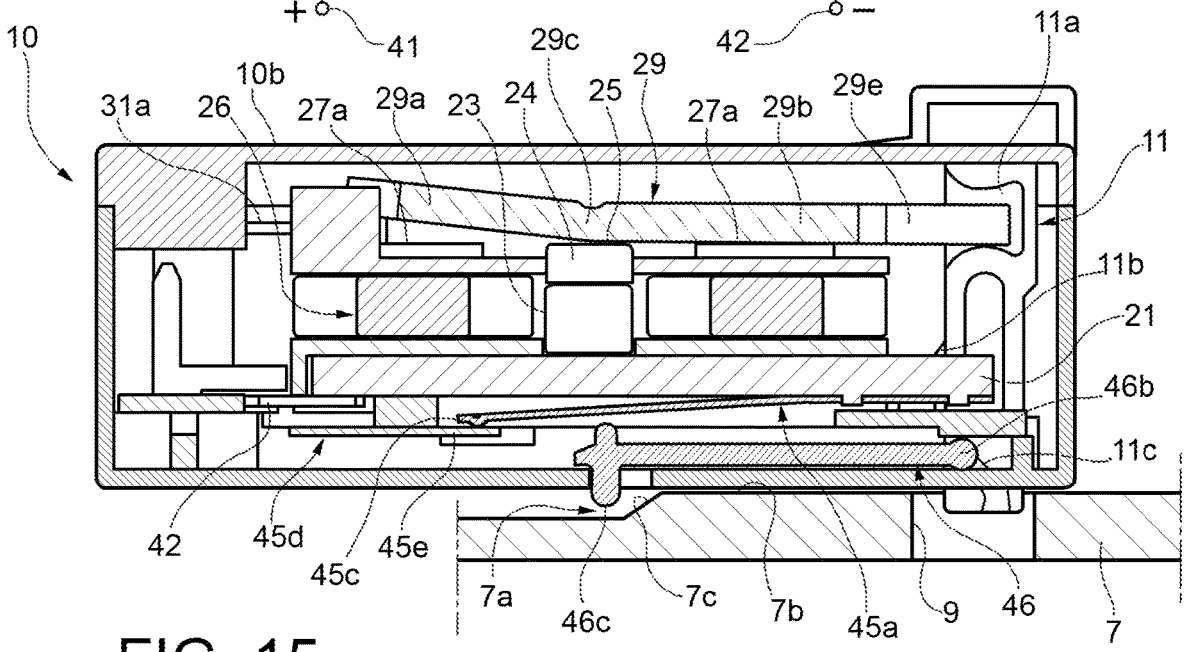
FIGS. 15 and 16 are sectional views of the device of FIGS. 2 and 3, in a condition corresponding to the state of the electrical diagram shown in FIG. 14.

The movable locking member 11 is movable following an activation command of the household electrical appliance to which the door-locking device 1 is associated, from a rest position, shown in FIGS. 9 and 12, to a lock position, illustrated in FIG. 15, wherein it is adapted to allow and respectively impede the movement of the latching slider 7. In the locked position, the locking pin 11 engages a lock opening 9 formed on the latching slider 7.

Figure 5:
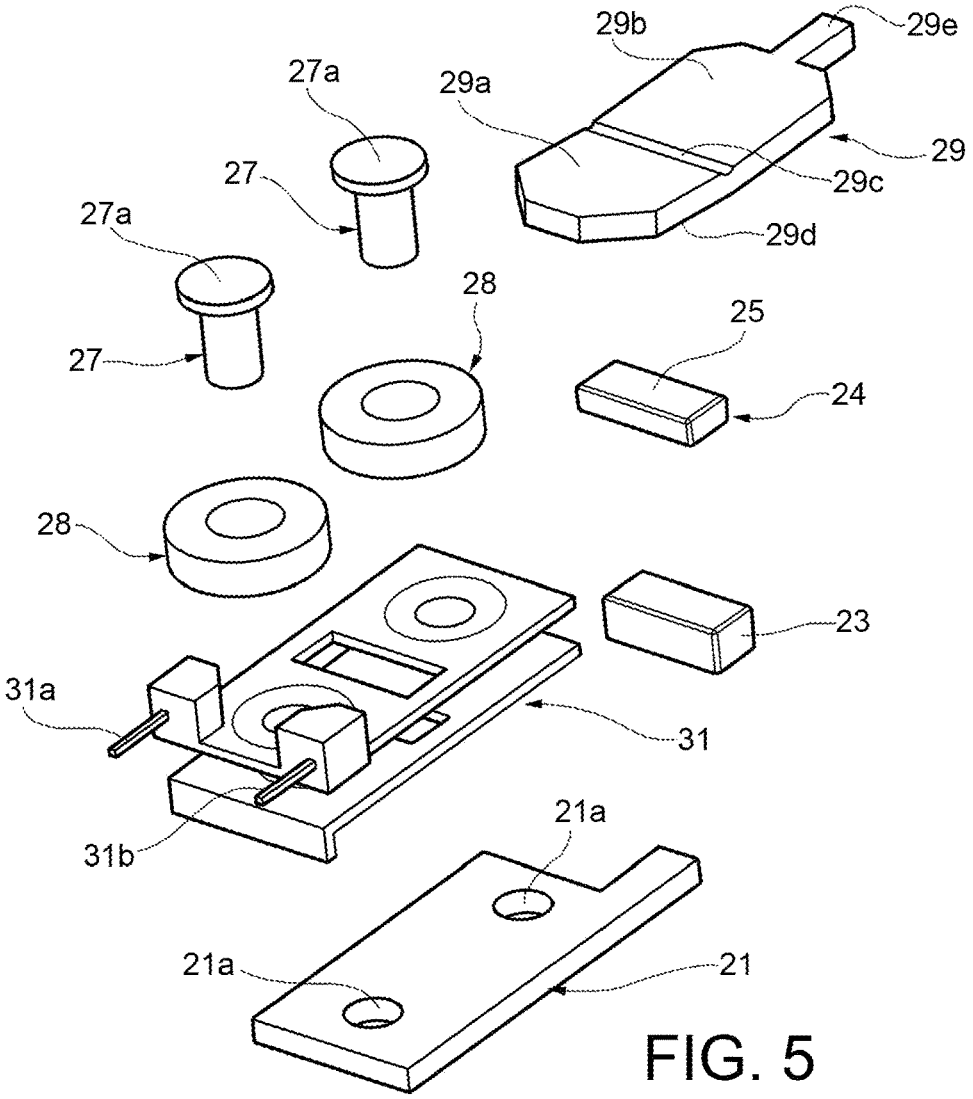
Figure 7:
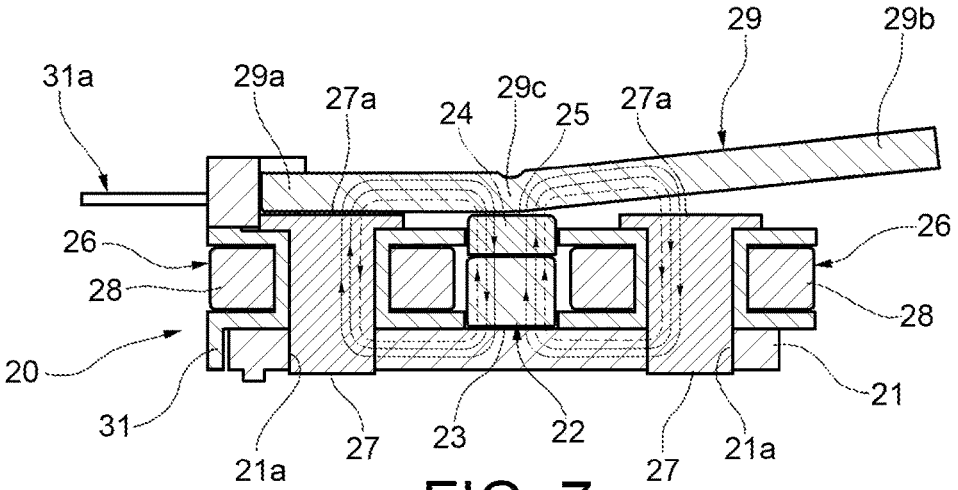
FIGS. 7 and 8 are sectional views representing a magnetic actuator of the device of FIGS. 2 and 3, in two different operating positions.
Figure 8:
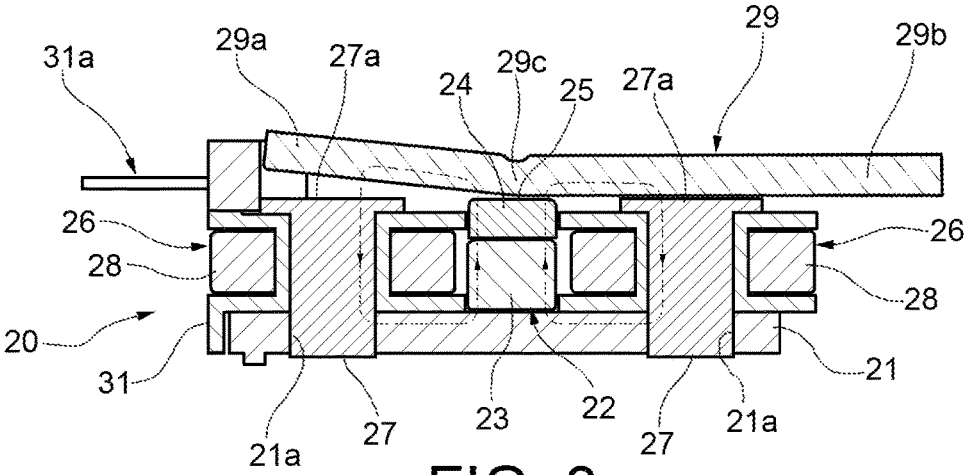

The device 10 comprises a magnetic actuator 20, housed in the casing 10*b* and shown in particular in FIGS. 5 and 7 to 8. The magnetic actuator 20 is provided for controlling the movement of the locking pin 11.

The magnetic actuator 20 comprises a plate or yoke 21 fixed to the casing 10*b* and made of magnetically conductive material, such as iron. The yoke 21 has two through-holes 21*a* formed on opposite ends of the yoke.

The actuator 20 further comprises a magnet part 22, comprising a permanent magnet 23 and an armature 24. The permanent magnet 23 is fixed approximately to the center of the yoke 21. The armature 24 is made of magnetically conductive material, e.g. iron, and is fixed to an upper surface of the permanent magnet 23. The armature 24 comprises a support surface 25 facing the side opposite to the yoke 21 (upper surface in the illustrated example).

The actuator 20 further comprises two electromagnets 26. Each electromagnet 26 comprises a core 27 of magnetically conductive material, such as iron, fixed in a respective through-hole 21*a* of the yoke 21, and a solenoid 28, wound around the core 27. Each core 27 comprises a retaining surface 27*a* facing the side opposite to the yoke 21. The two retaining surfaces 27*a* are coplanar with the support surface 25.

The actuator 20 further comprises a rocking keeper 29. The keeper 29 is made of magnetically conductive material, e.g. iron, and includes a first arm 29*a* and a second arm 29*b*. The first arm 29*a* and the second arm 29*b* have a planar shape and are joined at an angle to one another, through a corner portion 29*c* of the keeper. At the corner portion 29*c*, an edge 29*d* is formed which rests on the support surface 25 of the magnet part 22. The keeper 29 is preferably formed as a monolithic structure. The second arm 29*b* of the keeper 29 may be connected to the locking pin 11 directly or through an articulation. In the illustrated example, the second arm 29*b* has an appendage 29*e* inserted in a seat 11*a* formed on the pin 11.

The actuator 20 further comprises a support structure 31 of electrically insulating material, for example plastic, which is configured in such a way as to insulate the solenoids 28 with respect to the respective cores 27, the yoke 21 and the magnet part 22.

The insulation structure 31 supports two conductor leads 31*a* and 31*b* for sending electrical control signals to the electromagnets.

Figure 6:
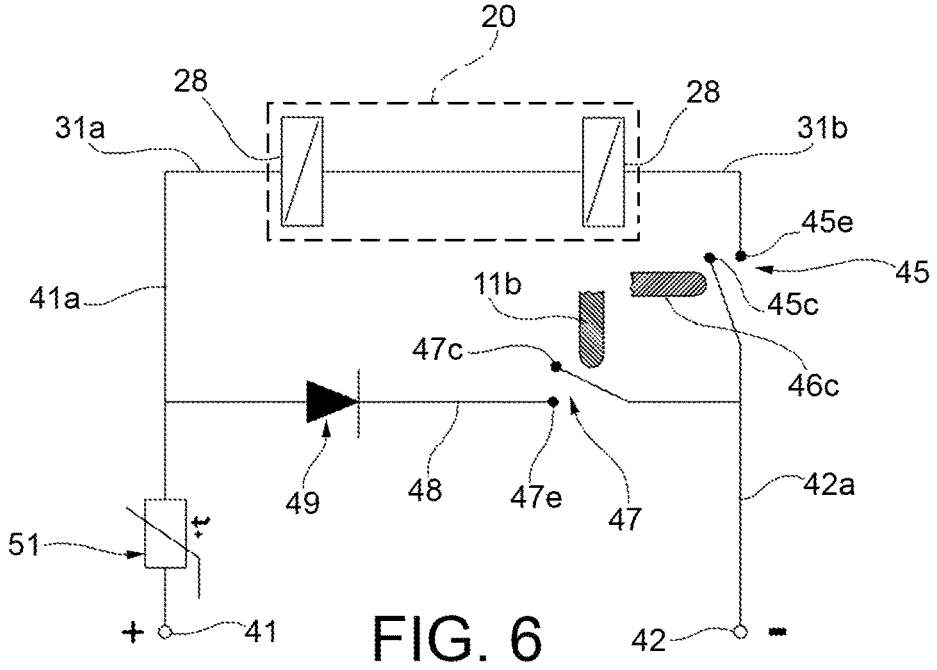
FIG. 6 is an electrical control diagram of the device of FIGS. 2 and 3.

The solenoids 28 of the electromagnets 26 are preferably wound in opposite directions and connected in series, as shown in FIG. 6.

In a first position (FIG. 7), the first arm 29*a* of the keeper is in contact with the retaining surface 27*a* of the core 27 spaced apart from the pin 11 and with one half of the support surface 25 spaced apart from the pin 11. Since the armature 24, the keeper 29, the core 27 and the yoke 21 are all magnetically permeable, the flow of the magnetic field of the permanent magnet 23 is as shown with dashed arrows in FIGS. 7 and 8. Consequently, the magnetic force caused by the permanent magnet 23 between the first arm 29*a* and the respective core 27 is greater than that between the second arm 29*b* and the respective core 27. The keeper 29, therefore, remains in the first position without applying electrical power external to the device 10.

When it is necessary to switch the actuator 20, a pulse is applied to the electromagnet through the conductor leads 31*a* and 31*b*. The electromagnet 26, spaced apart from the pin 11, thus generates a magnetic field, the flow of which is shown with the continuous arrows in FIG. 7. In this case, the magnetic field generated by the electromagnet 26, spaced apart from the pin 11, opposes the magnetic field generated by the permanent magnet 23 between the electromagnet 26, spaced apart from the pin 11, and the first arm 29*a* of the keeper. At the same time, the magnetic field generated by the electromagnet 26 near the pin 11 (connected in series and with opposite winding) positively overlaps the magnetic field generated by the permanent magnet 23 between the electromagnet 26 near the pin 11 and the second arm 29*b* of the keeper. Consequently, the magnetic force between the core 27 closer to the pin 11 and the second arm 29*b* is greater than that between the core 27 further from the pin 11 and the first arm 29*a*, and thus the second arm 29*b* moves to enter into contact with the core 27, closer to the pin 11, by switching the keeper 29 over to a second position (FIG. 8).

In the second position, the second arm 29*b* is in contact with the retaining surface 27*a* of the core 27 closer to the pin 11 and with the middle of the support surface 24 near the pin 11. To move the armature back to the first position, a pulse is applied, opposite to the preceding one, to the conductor leads 31*a* and 31*b*.

With reference in particular to FIG. 6, the device 10 further comprises a first and a second electrical control terminal 41, 42 connected to the magnetic actuator 20, respectively at the conductor leads 31*a* and 31*b*, by respective first and second lines 41*a* and 42*a*.

Moreover, a detection switch 45 is provided, arranged in series with the magnetic actuator 20. As will be explained below, the detection switch 45 is able to switch between an open position (FIGS. 6 and 9) and a closed position (FIGS. 12 and 13) following a movement of the latching slider 7. In particular, the detection switch 45 is adapted to detect a condition of opening/closing of the electrical household appliance door.

A lock switch 47 is also connected to the second terminal 42. As will be explained below, the lock switch 47 is able to switch between an open position (FIGS. 6 and 9) and a closed position (FIG. 14) following a movement of the locking pin 11. In particular, the lock switch 47 is adapted to detect a condition for locking/unlocking the electrical household appliance door.

In the example of FIG. 6, the lock switch 47 is connected to the terminals 41 and 42, through a third line 48 arranged in parallel with the magnetic actuator 20. In the third line 48, a diode 49 is also provided, arranged in series with the lock switch 47. A protection thermistor 51, specifically, a PTC, is also provided between the first terminal 41 and the connection between the first line 41*a* and the third line 48. Alternatively, such thermistor may be arranged on the first line 41*a*, between the electric actuator 20 and the connection between the first line 41*a* and the third line 48.

In the illustrated example, the detection switch 45 comprises a flexible elongated leaf 45*a* of electrically conductive material, which extends along the movement direction of the latching slider 7. The leaf 45*a* has a fixed end 45*b*, fixed to the yoke 21 on the side opposite the magnetic actuator 10, and a movable contact element 45*c*. Via its fixed end 45*b*, the leaf 45*a* is conductively connected to the yoke 21 of the magnetic actuator. The detection switch 45 further comprises a fixed leaf 45*d*, fixed to the casing 10*b* of the device 10. The fixed leaf 45*d* has a fixed contact element 45*e*, which, in the closed position of the detection switch 45, is contacted by the movable contact element 45*c* of the flexible leaf 45*a*, and a second end 45*f*, which is conductively connected by a contact spring 45*g* (or other types of conductive elements) with one of the conductor leads, 31*b*, of the magnetic actuator 20.

A control member 46 is provided for closing/opening the detection switch 45. Such control member 46 comprises a lever 46*a* extending along the direction of movement of the slider 7 and having a pin end 46*b* around which the lever is able to rotate along an axis transverse to the direction of movement of the slider 7, and a follower end 46*c* able to engage a cam 7*a* formed on the face of the latching slider 7 facing the device 10. Such cam 7*a* essentially comprises a first surface 7*b* extending parallel to the direction of movement of the slider 7, and a second surface 7*c* inclined with respect to such direction, which extends from the first surface 7*b* away from the device 10. A part of the follower end 46*c* of the lever 46*a* protrudes through a window 10*c* formed in the casing 10*b* of the device 10, in order to be in contact with the slider 7. In the open condition of the detection switch 45 (FIG. 9), the movable contact element 45*c* of the flexible leaf 45*a* is maintained spaced apart from the fixed contact element 45*e* of the fixed leaf 45*d* by the engagement with the raised follower end 46*c* of the control member 46, against the action of the elastic force of the flexible leaf 45*a*. In the closed condition of the detection switch 45 (FIG. 12), the follower end 46*c* of the control member 46 is lowered, allowing the movable contact element 45*c* of the flexible leaf 45*a* to be in contact with the fixed contact element 45*e* of the fixed leaf 45*d*, due to the elastic force of the flexible leaf 45*a*.

In the illustrated example, the lock switch 47 comprises a flexible elongated leaf 47*a*, made of electrically conductive material, which extends transversely to the movement direction of the latching slider 7. The leaf 47*a* has a fixed end 47*b*, fixed to the fixed end 45*b* of the leaf 45*a* of the detection switch 45, and a movable contact element 47*c*. Via its fixed end 47*b*, the leaf 47*a* is conductively connected to the leaf 45*a* of the detection switch 45 and to the yoke 21 of the magnetic actuator. The lock switch 47 further comprises a fixed leaf 47*d*, fixed to the casing 10*b* of the device 10. The fixed leaf 47*d* has a fixed contact element 47*e*, which, in the closed position of the lock switch 47, is contacted by the movable contact element 47*c* of the flexible leaf 47*a*, and a second end 47*f*, which is conductively connected to an end of the diode 49.

A control member is provided for closing/opening the lock switch 47. Such control member comprises an appendage 11*b* formed integrally with the locking pin 11 extending along the direction of movement of the slider 7. In the open condition of the lock switch 47 (FIG. 13), the movable contact element 47*c* of the flexible leaf 47*a* is spaced apart from the fixed contact element 47*e* of the fixed leaf 47*d* by the engagement due to the position of the flexible leaf 47*a*. In the closed condition of the lock switch 47 (FIG. 16), due to the movement of the locking pin 11, the appendage 11*b* of the pin engages the flexible leaf 47*a*, keeping the movable contact element 47*c* of the flexible leaf 47*a* in contact with the fixed contact element 47*e* of the fixed leaf 47*d* against the action of the elastic force of the flexible leaf 47*a*.

The lead of the diode 49 not in contact with the fixed leaf 47*b* of the lock switch 47 is connected with one lead of the protection thermistor 51, which is also connected, via a contact spring 52, with the other conductor lead, 31*a*, of the magnetic actuator 20.

The other end of the protection thermistor 51 is conductively connected to the first terminal 41, which is fixed to the casing 10*b* of the device 10. The second terminal 42 is fixed to the yoke 21 and is also conductively connected thereto.

The first line 41*a* therefore extends from the first terminal 41, comprising the thermistor 51, the contact spring 52 and one of the conductor leads 31*a* of the magnetic actuator. The second line 42*a* extends from the second terminal, comprising the yoke 21, the flexible leaf 45*a* and the fixed leaf 45*d* of the detection switch 45, the contact spring 45*g* and the other conductor lead 3 *lb* of the magnetic actuator. The third line, on the other hand, comprises the diode 49, the fixed leaf 47*d* and the flexible leaf 47*a* of the lock switch 47.

Figure 10:
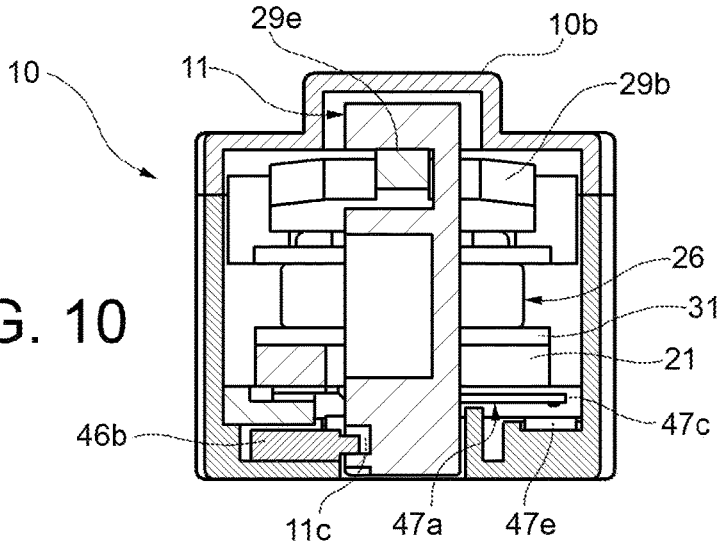

In resting and open-door conditions (FIGS. 6 and 9 to 10), the latching slider 7 overlaps the opening 10*a* of the locking pin 11, impeding the movement of the latter, and pushes the follower end 46*c* of the control member 46, which forces the detection switch 45 to open.

In these conditions, even a possible electrical pulse does not generate any movement as the circuit is open, which may be verified by monitoring the resistance of the circuit through the two terminals 41 and 42.

Figure 11:
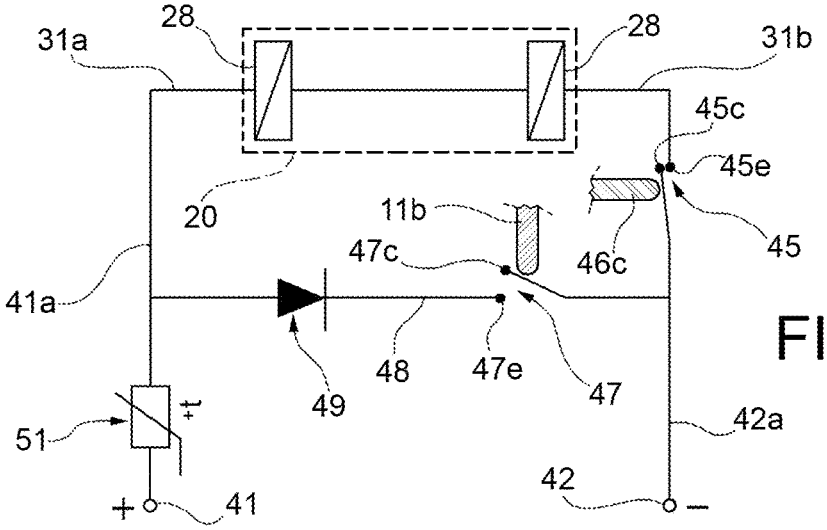
FIG. 11 shows the electrical diagram in a different state from that shown in FIG. 6.
Figure 13:
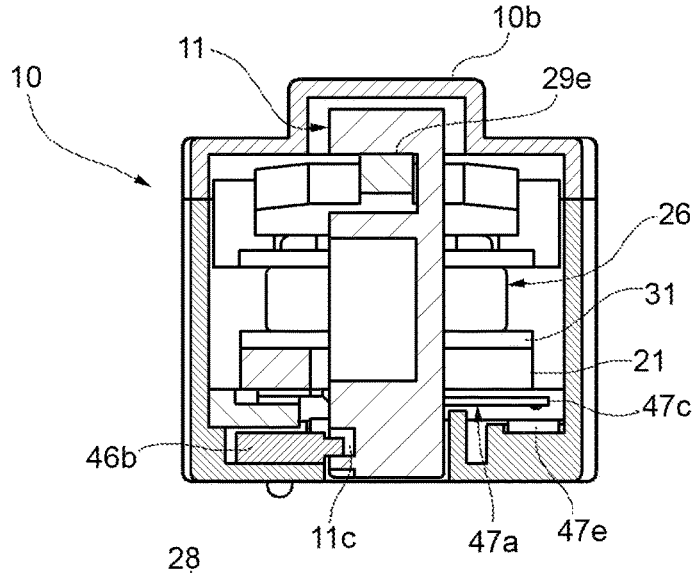

When the door is closed, the entry of the coupling member 4 in the door-lock mechanism causes a movement of the latching slider 7, which frees the area of the locking pin 11 and at the same time frees the follower end 46*c* of the control member 46 of the detection switch 45. Due to the preloading of the flexible leaf 45*a*, the detection switch 45 is closed (FIGS. 11 to 13).

This condition may be controlled by the electronics of the machine by measuring the resistance between the two terminals 41, 42 with a voltage which will result in a resistance equal to the series of resistances of the solenoids 28 with that of the protection PTC 51.

Figure 14:
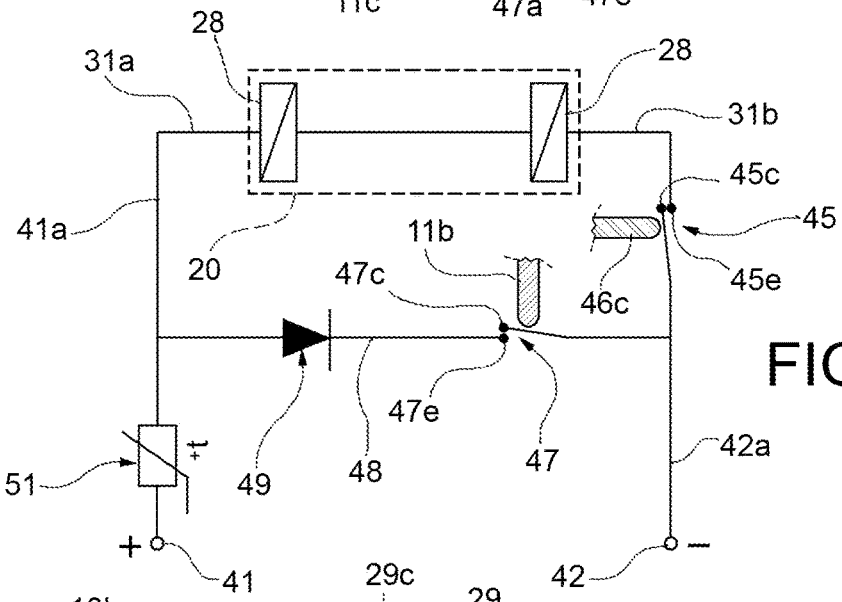
FIG. 14 shows the electrical diagram in a different state from that shown in FIGS. 6 and 11.
Figure 16:
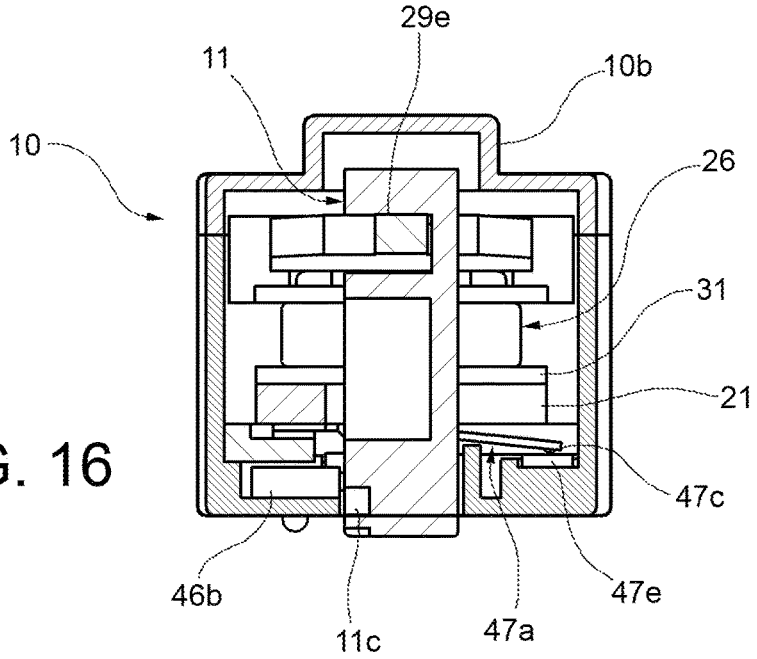

In the state thus described, it is possible to provide a pulsed power supply between the terminals 41, 42 which causes the activation of the magnetic actuator 20 with the consequent rotation of the keeper 29 and the escape of the locking pin 11 with closure of the lock switch 47 (FIGS. 14 to 16).

This condition may be identified through the electronics by passing a detection current in the circuit with a proper polarity with respect to the operating direction of the diode and measuring the resistance of the circuit, which will have a value equal to that of the protection PTC 51.

To unlock the door, it is sufficient to give a current pulse to the leads of the terminals 41, 42 with polarity opposite to the locking pulse to rotate the keeper 29 into the rest position (first position) and open the lock switch 47.

Figure 17:
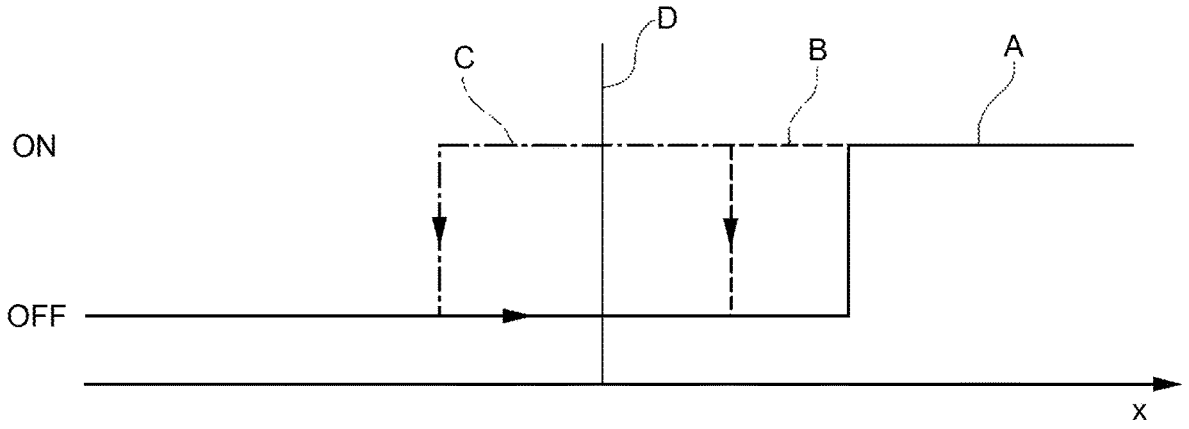
FIG. 17 shows a graph illustrating the behavior of a detection switch according to the position of a latching slider of the door-locking device.
Figure 18:
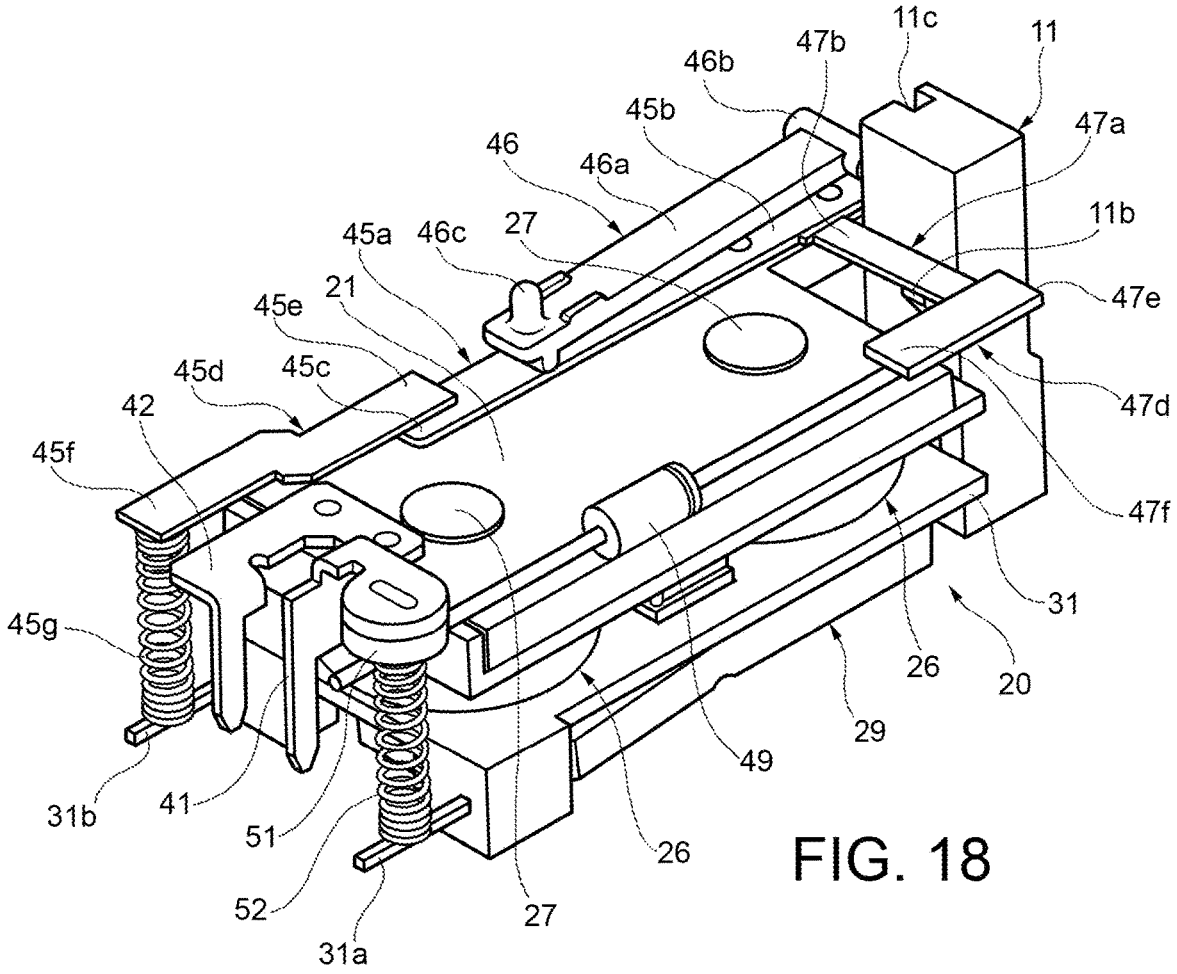
FIGS. 18 and 19 are perspective and plan views of the device of FIGS. 2 and 3, without casing.
Figure 19:
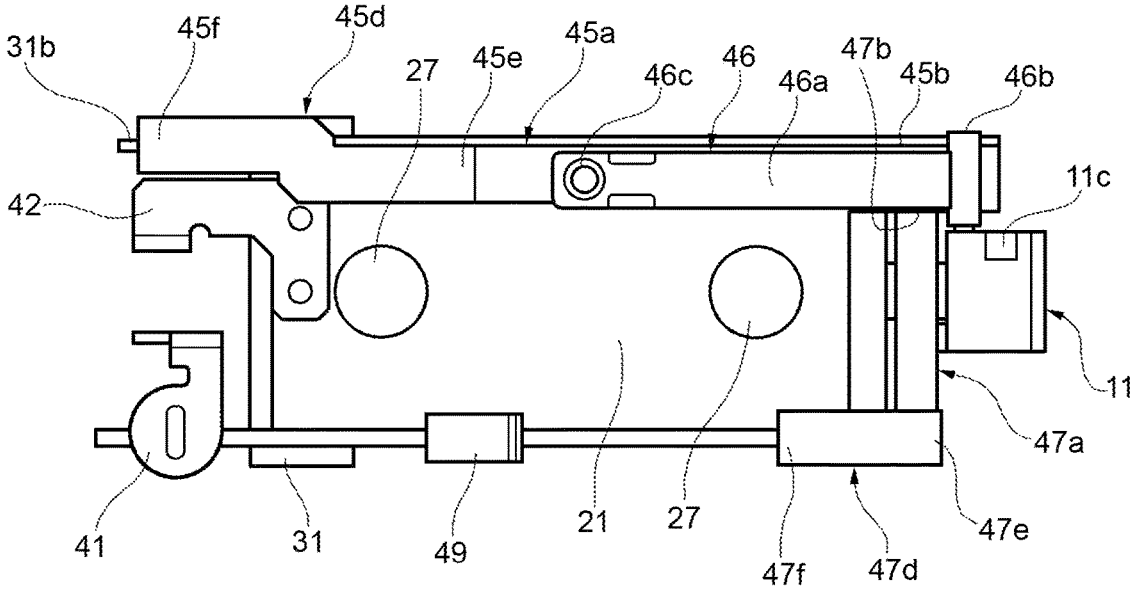

The device described above makes it possible to increase the hysteresis of the detection switch 45. With reference to the graph of FIG. 17, the position x of the latching slider 7 is shown in the abscissa. The continuous line A represents the signal provided by the detection sensor 45 when the electrical household appliance door is closed. The dashed line B represents the signal provided by the detection sensor 45 in the step of opening the door in the unlocked door condition. The dashed line and point C represents the signal provided by the detection sensor 45 during the step of opening the door in the locked door condition. The vertical line D represents the position from which the latching slider 7 may be locked by the locking pin 11, i.e., the position from which the lock opening 9 of the slider 7 allows the locking pin 11 to move.

The position of the step of curve A depends on the positioning of the inclined cam 7*c* with respect to the lock opening 9 of the slider 7.

In the unlocked pin condition (curve B), the hysteresis of the detection switch 45 (due to the characteristics of the flexible leaf 45*a*) is entirely within the lockable range.

In the case of locked conditions (curve C), the detection switch 45 must be kept in a closed condition beyond the position of line D, in order to prevent a false opening signal from impeding the power supply to the domestic appliance.

To this end, an increased hysteresis is created of the detection switch 45 in the condition of a locked door, which allows the state of contact in the closed condition to be maintained. In order to obtain an increased hysteresis, as may be seen from the comparison between FIGS. 12 and 15, the pin end 46*b* of the control member 46 of the detection switch 45 is arranged to slide within the casing 10*b* of the device 10 in a direction parallel to the direction of movement of the slider 7. The pin end 46*b* of the drive member 46 is coupled to an inclined cam 11*c* formed on a surface of the locking pin 11 facing the pin end 46*b* of the control member 46. In this way, the movement of the locking pin 11 in a direction substantially perpendicular to the sliding direction of the slider 7 causes a movement of the control member 46 parallel to the sliding direction of the slider 7, such as to move the follower end 46*c* of the control member 46 away from the inclined cam 7*c* of the slider 7. Thus, a change in the open position of the detection switch 45 is obtained.

Figure 20:
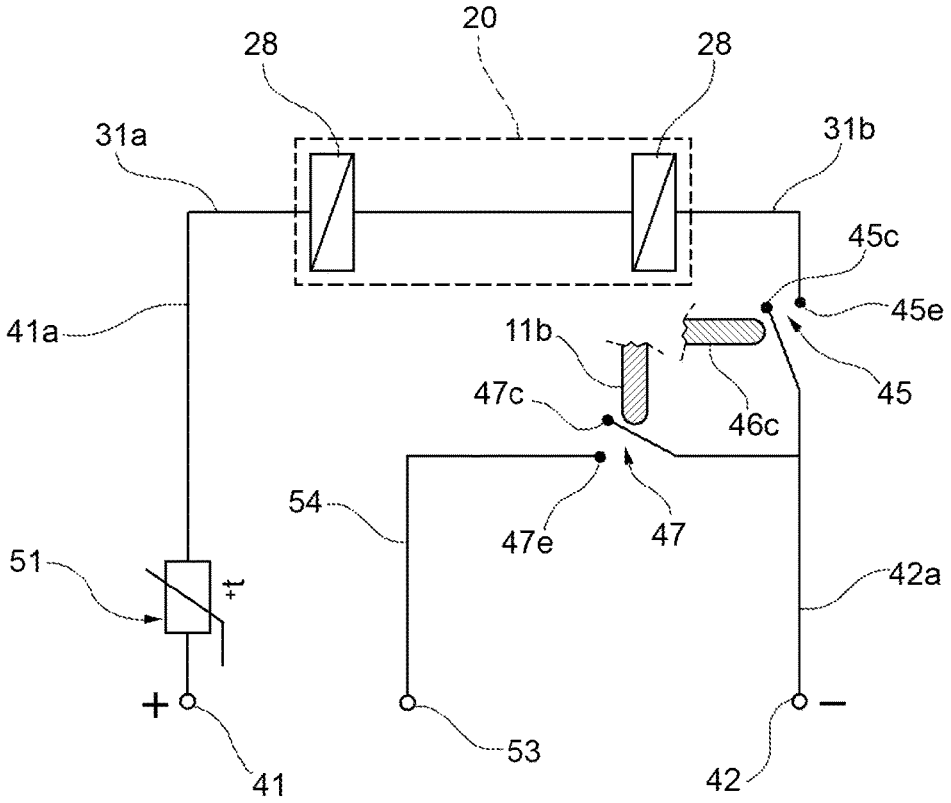
FIG. 20 represents an alternative embodiment of an electrical control diagram of the device of FIGS. 2 and 3.
Figure 21:
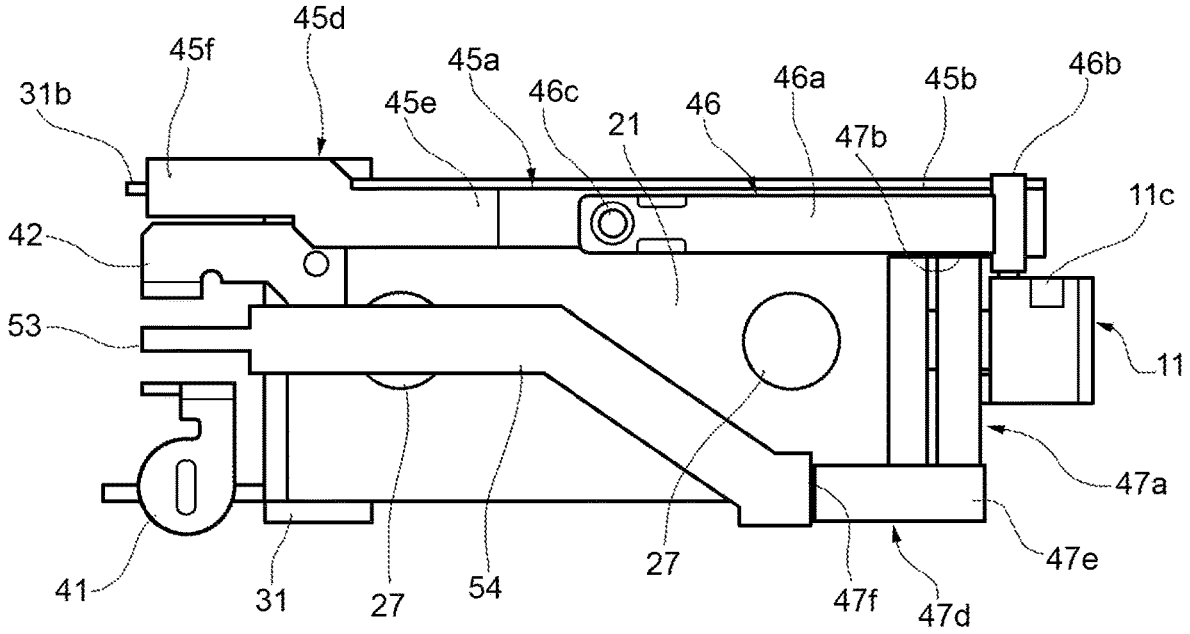
FIG. 21 is a plan view of an embodiment of the device of FIGS. 2 and 3, which implements the electrical diagram of FIG. 20.

With reference to FIGS. 20 and 21, an alternative embodiment of the electromechanical control device described above is now described.

A feature of the device is in effect the modularity, which allows the configuration with two terminals described above to be transformed into a configuration with three terminals with few changes of the device.

The same reference numbers have been assigned to elements corresponding to those of the preceding embodiment. Such elements will not be further described.

In such an embodiment, the fixed contact element 47*e* of the lock switch 47 is connected to a third terminal 53, or auxiliary terminal, and no longer to the first line 41*a*, and therefore the diode is absent. Such additional terminal 53 allows the closing of the lock switch 47 to be monitored, while the function of monitoring the closing of the detection switch 45 and activating/deactivating the door lock remains at the terminals 41 and 42.

As shown in FIG. 21, the fixed leaf 47*e* is conductively connected to one end of a connecting leaf 54, fixed to the casing 10*b* of the device, the opposite end of which bears the additional terminal 53.

The invention claimed is:

1. A door-locking device for an electrical household appliances, the electrical household appliance comprising a door, a coupling member connected to the door, and a movable latching slider being engaged by the coupling member to latch the door when the door is closed, wherein the door-locking device comprises an electromechanical control device including a locking pin adapted to cooperate with the movable latching slider to lock the door, said locking pin being movable between a rest position, wherein the locking pin allows the latching slider to move, and a lock position, wherein the locking pin prevents said latching slider from moving;

wherein said electromechanical control device comprises a planar yolk of magnetically conductive material;

a magnet part fixed to the planar yolk and comprising a permanent magnet polarized in a direction substantially perpendicular to the plane of the planar yolk;

two electromagnets between which the magnet part is interposed, each electromagnet comprising a core of magnetically conductive material fixed to the yoke, and a solenoid wound to the core; and a rocking keeper of magnetically conductive material, comprising two arms connected to each other through a corner portion of the keeper, said corner portion resting on a support surface of the magnet part in such a way that the keeper is able to rock around the corner portion, between a first and a second position in contact with one or the other of the cores of the electromagnets, respectively;

wherein the locking pin is connected to one of the arms of the keeper in such a way as to assume the rest position or the lock position when the keeper is in the first position or in the second position, respectively.

2. A door-locking device according to claim 1, wherein the electromechanical control device further comprises a detection switch, said detection switch being able to switch between an open position and a closed position upon motion of the latching slider.

3. Door-locking device according to claim 2, wherein the detection switch is arranged in series with the solenoids of the electromagnets, between a first and a second electrical terminal of the electromechanical control device.

4. A door-locking device according to claim 2, wherein the detection switch comprises a fixed contact element and a movable contact element resiliently stressed in closure towards the fixed contact element, and a rotatable control member having a follower end adapted to engage a cam formed on the latching slider, in such a way that the control member is movable between a first position wherein the follower end of the control member keeps the movable contact element away from the fixed contact element, and a second position wherein the follower end of the control member allows the movable contact element to come in contact with the fixed contact element.

5. A door-locking device according to claim 1, wherein the electromechanical control device further comprises a lock switch, said lock switch being able to switch between an open position and a closed position upon motion of the locking pin.

6. Door-locking device according to claim 5, further comprising a detection switch able to switch between an open position and a closed position following a movement of the latching slider, wherein the detection switch is arranged in series with the solenoids of the electromagnets, between a first and a second electrical terminal of the electromechanical control device, and wherein the lock switch is connected on one lead to a third terminal, and on the other lead to a line between the first and second electrical terminals.

7. A door-locking device according to claim 5, wherein the lock switch comprises a fixed contact element and a movable contact element, and a control appendage integral with the locking pin and adapted to engage the movable contact element, in such a way that the control appendage is movable between a first position, wherein the movable contact element is spaced away from the fixed contact element, and a second position, wherein the control appendage keeps the movable contact element in contact with the fixed contact element against the action of an elastic force exerted on the movable contact element.

* * * * *